US011661913B2

(12) United States Patent
Kaswer et al.

(10) Patent No.: US 11,661,913 B2
(45) Date of Patent: May 30, 2023

(54) FUEL PUMP WITH INLET VALVE ASSEMBLY

(71) Applicant: DELPHI TECHNOLOGIES IP LIMITED, St. Michael (BB)

(72) Inventors: Brandon Kaswer, Rochester, NY (US); Joseph G. Spakowski, Rochester, NY (US); Robert Merkov, Webster, NY (US)

(73) Assignee: Delphi Technologies IP Limited, St. Michael (BB)

( * ) Notice: Subject to any disclaimer, the term of this patent is extended or adjusted under 35 U.S.C. 154(b) by 0 days.

(21) Appl. No.: 17/321,826

(22) Filed: May 17, 2021

(65) Prior Publication Data

US 2022/0364535 A1 Nov. 17, 2022

(51) Int. Cl.

| | |
|---|---|
| ***F02M 59/46*** | (2006.01) |
| ***F02M 59/02*** | (2006.01) |
| ***F02M 59/36*** | (2006.01) |
| ***F04B 49/24*** | (2006.01) |

(52) U.S. Cl.

CPC ..... *F02M 59/466* (2013.01); *F02M 59/027* (2013.01); *F02M 59/367* (2013.01); *F02M 59/464* (2013.01); *F04B 49/243* (2013.01)

(58) Field of Classification Search

CPC ..... F04B 49/005; F04B 39/00; F04B 39/10; F04B 7/0076; F04B 49/243; F02M 59/466; F02M 59/464; F02M 59/027; F02M 59/367; F02M 59/36–59/368; F04D 13/0606

See application file for complete search history.

(56) References Cited

U.S. PATENT DOCUMENTS 7,401,594 B2 7/2008 Usui et al.
7,707,996 B2 * 5/2010 Yamada ..... F04B 53/166 123/506
9,810,232 B2 * 11/2017 Høj ..... F04D 13/0606

(Continued)

FOREIGN PATENT DOCUMENTS

DE 102010031600 A1 1/2012
DE 102014200695 A1 7/2015
WO WO-2014206670 A1 * 12/2014 ..... F02M 59/366

OTHER PUBLICATIONS

Machine assigned translation of DE102010031600A1 obtained from patents.google.com/patents on Sep. 9, 2022, 5 pages.

(Continued)

*Primary Examiner* — Philip E Stimpert
(74) *Attorney, Agent, or Firm* — Joshua M. Haines

(57) ABSTRACT

A fuel pump includes a pump housing with a pumping chamber an inlet valve bore. An inlet valve selectively provides and prevents fluid communication between an inlet of the fuel pump and the pumping chamber. The inlet valve includes an inner housing received within the inlet valve bore such that an outer periphery of the inner housing is sealed to an inner periphery of the inlet valve bore. An outer housing circumferentially surrounds the inner housing. An annular chamber is defined radially between the inner housing and the outer housing and axially between the outer housing and the pump housing. A sealing ring is located within the annular chamber such that the sealing ring is compressed axially against the pump housing and the outer housing.

10 Claims, 8 Drawing Sheets

(56) References Cited

U.S. PATENT DOCUMENTS

| | | | |
|---|---|---|---|
| 10,871,136 | B2 | 12/2020 | Dauer et al. |
| 2003/0217736 | A1 | 11/2003 | Onishi et al. |
| 2005/0178441 | A1 | 8/2005 | Yamaguchi et al. |
| 2013/0098338 | A1 | 4/2013 | Usui et al. |
| 2016/0215744 | A1 | 7/2016 | Muehlbauer et al. |

OTHER PUBLICATIONS

Machine assigned translation of DE102014200695A1 obtained from patents.google.com/patents on Sep. 9, 2022, 8 pages.

* cited by examiner

FUEL PUMP WITH INLET VALVE ASSEMBLY

TECHNICAL FIELD OF INVENTION

The present invention relates to a fuel pump which supplies fuel to an internal combustion engine, more particularly to such a fuel pump which includes an inlet valve assembly, and even more particularly to such a fuel pump with an inlet valve assembly which is robust to exterior environmental fluid exposure.

BACKGROUND OF INVENTION

Fuel systems in modern internal combustion engines fueled by gasoline, particularly for use in the automotive market, employ gasoline direct injection (GDi) where fuel injectors are provided which inject fuel directly into combustion chambers of the internal combustion engine. In such systems employing GDi, fuel from a fuel tank is supplied under relatively low pressure by a low-pressure fuel pump which is typically an electric fuel pump located within the fuel tank. The low-pressure fuel pump supplies the fuel to a high-pressure fuel pump which typically includes a fuel pump housing and a pumping plunger which is reciprocated, by a camshaft of the internal combustion engine, within the fuel pump housing. Reciprocation of the pumping plunger further pressurizes the fuel in order to be supplied to fuel injectors which inject the fuel directly into the combustion chambers of the internal combustion engine. During operation, the internal combustion engine is subject to varying demands for output torque. In order to accommodate the varying output torque demands, the mass of fuel delivered by each stroke of the pumping plunger must also be varied. One strategy to vary the delivery of fuel by the high-pressure fuel pump is to use an inlet valve assembly which includes a solenoid. The inlet valve assembly may allow a full charge of fuel to enter the pumping chamber during each intake stroke, however, the solenoid may be operated to cause the inlet valve assembly to remain open during a portion of a compression stroke of the pumping plunger to allow some fuel to spill back toward the source. When the solenoid is then operated to allow the inlet valve assembly to close, the remainder of the compression stroke pressurizes the fuel and discharges the fuel to the fuel injectors. It is known for the inlet valve assembly to be received within a bore of the fuel pump housing and extends outside of the fuel pump housing. In order to prevent leakage of fuel a sealing arrangement is provided to seal between the fuel pump housing and the inlet valve assembly. In some arrangements such as provided in U.S. Pat. No. 10,947,942 to Stritzel et al., a portion of the inlet valve assembly is welded to fuel pump housing in order to provide a sealed interface. In other arrangements such as provided in U.S. Pat. No. 7,401,594 to Usui et al., the inlet valve assembly may be sealed to the fuel pump housing by providing an O-ring radially between the inlet valve assembly and the fuel pump housing. In each case, the sealing arrangement is provided for preventing fuel from exiting the fuel pump housing between the inlet valve assembly and the fuel pump housing. However, portions of the inlet valve assembly which extend outside of the fuel pump housing may be exposed to environmental conditions which may cause liquids, such as rainwater or saltwater from deiced roadways, from being deposited on the outlet control valve. These liquids may seep into interfaces of components that form the inlet control valve or solenoid and over time may compromise one or more of the components of the inlet control valve or solenoid which may lead to undesired operation of the inlet control valve.

What is needed is a fuel pump which minimizes or eliminates one or more of the shortcomings as set forth above.

SUMMARY OF THE INVENTION

Briefly described, a fuel pump includes a fuel pump housing with a pumping chamber defined therein and an inlet valve bore extending along an inlet valve bore axis to an exterior of the fuel pump housing; a pumping plunger which reciprocates within a plunger bore such that an intake stroke of the pumping plunger increases volume of the pumping chamber and a compression stroke of the pumping plunger decreases volume of the pumping chamber; and an inlet valve assembly which 1) selectively provides fluid communication between an inlet of the fuel pump and the pumping chamber and 2) selectively prevents fluid communication between the inlet of the fuel pump and the pumping chamber. The inlet valve assembly includes an inner housing which is received within the inlet valve bore such that the inner housing extends to the exterior of the fuel pump housing and such that an outer periphery of the inner housing is sealed to an inner periphery of the inlet valve bore such that fuel is prevented from passing radially between the inner housing and the inlet valve bore to the exterior of the fuel pump housing; an outer housing which is located outside of the fuel pump housing and circumferentially surrounds the inner housing, wherein an annular chamber is defined radially between the inner housing and the outer housing and axially between the outer housing and the fuel pump housing; and a sealing ring which is made of an elastomer material and which is annular in shape and located within the annular chamber such that the sealing ring is compressed axially against the fuel pump housing and the outer housing. The fuel pump as described herein with the sealing ring minimizes the likelihood of liquids from the exterior environment from reaching elements of inlet valve assembly which could otherwise lead to undesired operation.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
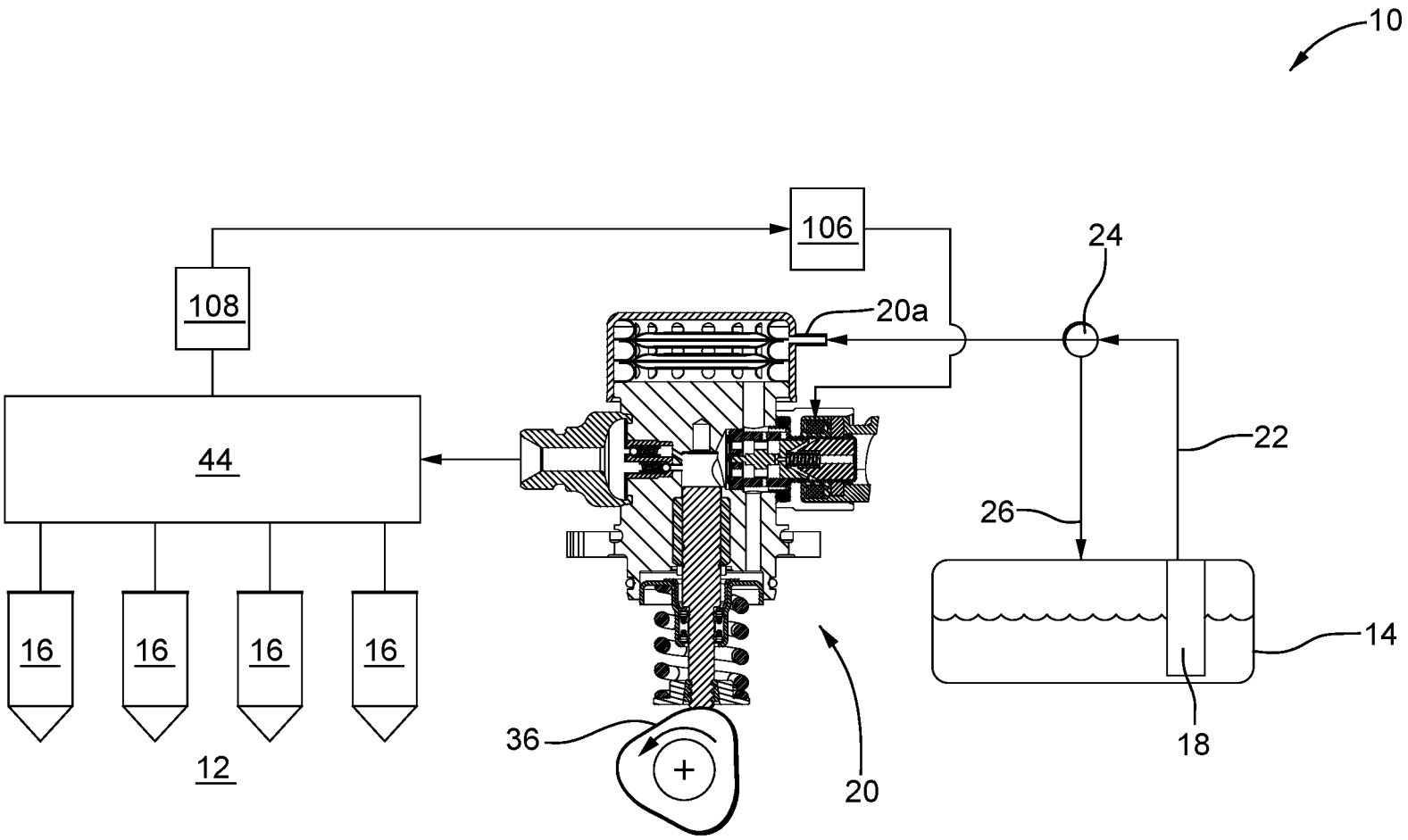
FIG. 1 is a schematic view of a fuel system including a fuel pump in accordance with the present invention.

In accordance with a preferred embodiment of this invention and referring initially to FIG. 1, a fuel system 10 for an internal combustion engine 12 is shown is schematic form. Fuel system 10 generally includes a fuel tank 14 which holds a volume of fuel to be supplied to internal combustion engine 12 for operation thereof; a plurality of fuel injectors 16 which inject fuel directly into respective combustion chambers (not shown) of internal combustion engine 12; a low-pressure fuel pump 18; and a high-pressure fuel pump 20 where the low-pressure fuel pump 18 draws fuel from fuel tank 14 and elevates the pressure of the fuel for delivery to high-pressure fuel pump 20 where the high-pressure fuel pump 20 further elevates the pressure of the fuel for delivery to fuel injectors 16. By way of non-limiting example only, low-pressure fuel pump 18 may elevate the pressure of the fuel to about 500 kPa or less and high-pressure fuel pump 20 may elevate the pressure of the fuel to above about 14 MPa and even above 35 MPa in some applications. While four fuel injectors 16 have been illustrated, it should be understood that a lesser or greater number of fuel injectors 16 may be provided.

As shown, low-pressure fuel pump 18 may be provided within fuel tank 14, however low-pressure fuel pump 18 may alternatively be provided outside of fuel tank 14. Low-pressure fuel pump 18 may be an electric fuel pump as are well known to a practitioner of ordinary skill in the art. A low-pressure fuel supply passage 22 provides fluid communication from low-pressure fuel pump 18 to high-pressure fuel pump 20. A fuel pressure regulator 24 may be provided such that fuel pressure regulator 24 maintains a substantially uniform pressure within low-pressure fuel supply passage 22 by returning a portion of the fuel supplied by low-pressure fuel pump 18 to fuel tank 14 through a fuel return passage 26. While fuel pressure regulator 24 has been illustrated in low-pressure fuel supply passage 22 outside of fuel tank 14, it should be understood that fuel pressure regulator 24 may be located within fuel tank 14 and may be integrated with low-pressure fuel pump 18.

Figure 2:
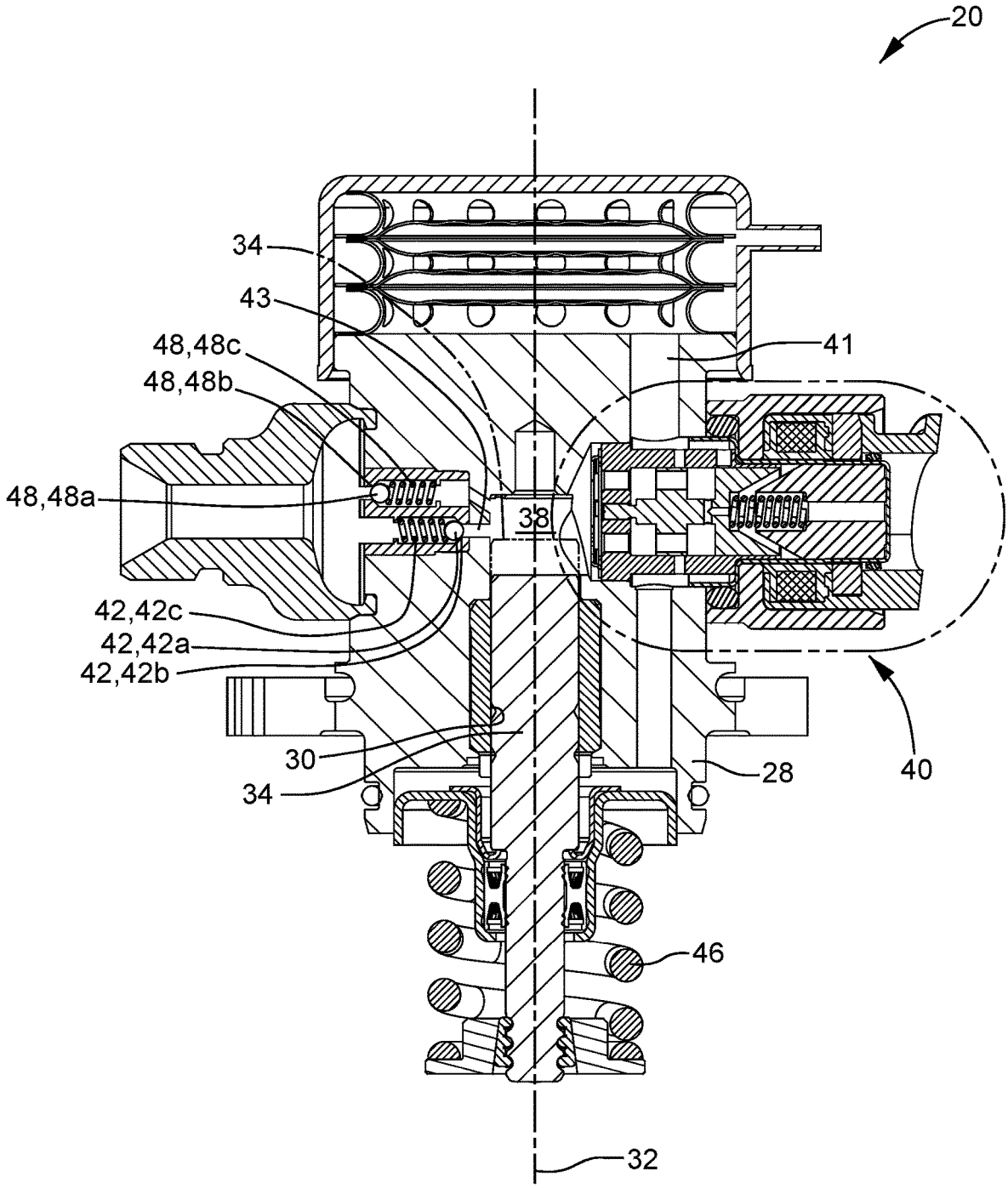
FIG. 2 is a cross-sectional view of the fuel pump of FIG. 1.
Figure 3:
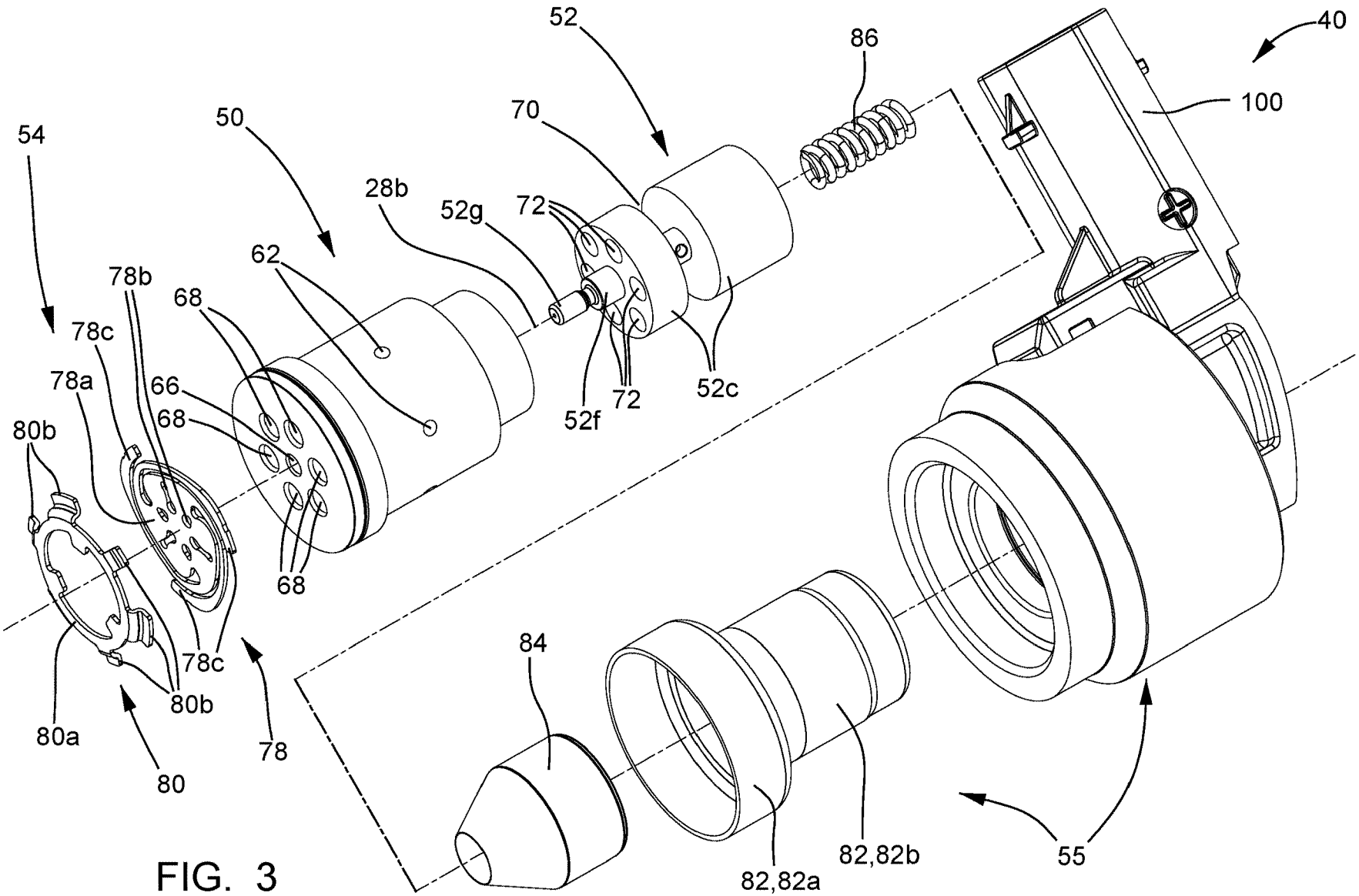
FIG. 3 is an exploded isometric view of an inlet valve assembly of the fuel pump of FIGS. 1 and 2.

Now with additional reference to FIG. 2, high-pressure fuel pump 20 includes a fuel pump housing 28 which includes a plunger bore 30 which extends along, and is centered about, a plunger bore axis 32. As shown, plunger bore 30 may be defined by a combination of an insert and directly by fuel pump housing 28. High-pressure fuel pump 20 also includes a pumping plunger 34 which is located within plunger bore 30 and reciprocates within plunger bore 30 along plunger bore axis 32 based on input from a rotating camshaft 36 of internal combustion engine 12 (shown only in FIG. 1). A pumping chamber 38 is defined within fuel pump housing 28, and more specifically, pumping chamber 38 is defined by plunger bore 30 and pumping plunger 34. An inlet valve assembly 40 of high-pressure fuel pump 20 is received within an inlet valve bore 28*a* of fuel pump housing 28 such that inlet valve bore 28*a* extends to the exterior of fuel pump housing 28, along an inlet valve bore axis 28*b* the high-pressure fuel pump 20 selectively provides and prevents fluid communication between an inlet 20*a* of high-pressure fuel pump 20 and pumping chamber 38 via a pump housing inlet passage 41 of fuel pump housing 28 while an outlet valve assembly 42 is located within an outlet passage 43 of fuel pump housing 28 and selectively allows fuel to be communicated from pumping chamber 38 to fuel injectors 16 via a fuel rail 44 to which each fuel injector 16 is in fluid communication. In operation, reciprocation of pumping plunger 34 causes volume of pumping chamber 38 to increase during an intake stroke of pumping plunger 34 (downward as oriented in FIG. 2) in which a plunger return spring 46 causes pumping plunger 34 to more downward, and conversely, the volume of pumping chamber 38 decrease during a compression stroke (upward as oriented in FIG. 2) in which camshaft 36 causes pumping plunger 34 to move upward against the force of plunger return spring 46. In this way, fuel is selectively drawn into pumping chamber 38 during the intake stroke, depending on operation of inlet valve assembly 40 as will be described in greater detail later, and conversely, fuel is pressurized within pumping chamber 38 by pumping plunger 34 during the compression stroke and discharged through outlet valve assembly 42 under pressure to fuel rail 44 and fuel injectors 16. For clarity, pumping plunger 34 is shown in solid lines in FIG. 2 to represent the intake stroke and pumping plunger 34 is shown in phantom lines in FIG. 2 to represent the compression stroke. High-pressure fuel pump 20 also includes a pressure relief valve assembly 48 which is arranged downstream of outlet valve assembly 42 in order to provide a fluid path back to pumping chamber 38 if the pressure downstream of outlet valve assembly 42 reaches a predetermined limit which may pose an unsafe operating condition if left unmitigated.

Outlet valve assembly 42 generally includes an outlet valve member 42*a*, an outlet valve seat 42*b*, and an outlet valve spring 42*c*. Outlet valve member 42*a*, illustrated by way of non-limiting example only as a ball, is biased toward outlet valve seat 42*b* by outlet valve spring 42*c* where outlet valve spring 42*c* is selected to allow outlet valve member 42*a* to open when a predetermined presser differential between pumping chamber 38 and fuel rail 44 is achieved. Outlet valve assembly 42 is oriented such that fuel is allowed to flow out of pumping chamber 38 through outlet valve assembly 42, however, fuel is not allowed to flow into pumping chamber 38 through outlet valve assembly 42.

Pressure relief valve assembly 48 generally includes a pressure relief valve member 48*a*, a pressure relief valve seat 48*b*, and a pressure relief valve spring 48*c*. Pressure relief valve member 48*a*, illustrated by way of non-limiting example only as a ball, is biased toward pressure relief valve seat 48*b* by pressure relief valve spring 48*c* where pressure relief valve spring 48*c* is selected to allow pressure relief valve member 48*a* when a predetermined presser differential between pumping chamber 38 and fuel rail 44 is achieved. Pressure relief valve assembly 48 is oriented such that fuel is allowed to flow into of pumping chamber 38 through pressure relief valve assembly 48, however, fuel is not allowed to flow out of pumping chamber 38 through pressure relief valve assembly 48.

Inlet valve assembly 40 will now be described with particular reference to FIGS. 3-7. Inlet valve assembly 40 includes a valve body 50, a valve spool 52 located within valve body 50, a check valve 54, and a solenoid assembly 55. The various elements of inlet valve assembly 40 will be described in greater detail in the paragraphs that follow.

Valve body 50 is centered about, and extends along, inlet valve bore axis 28*b* such that valve body 50 extends from a valve body first end 50*a* to a valve body second end 50*b*. A valve body bore 58 extends into valve body 50 from valve body first end 50*a* and terminates at a valve body end wall 60 which extends to valve body second end 50*b* such that valve body bore 58 is preferably cylindrical. A valve body first inlet passage 62 extends through valve body 50 such that valve body first inlet passage 62 extends from a valve body outer periphery 50*c* of valve body 50 and opens into valve body bore 58. A valve body second inlet passage 64 (not visible in FIG. 3, but visible in FIGS. 4-7) extends through valve body 50 such that valve body second inlet passage 64 extends from valve body outer periphery 50*c* and opens into valve body bore 58. As shown in the figures, valve body first inlet passage 62 and valve body second inlet passage 64 are spaced axially apart from each other along inlet valve bore axis 28*b* such that valve body second inlet passage 64 is located axially between valve body first end 50*a* and valve body first inlet passage 62. Also as shown in the figures, a plurality of valve body first inlet passages 62 may be provided such that each valve body first inlet passage 62 is located in the same axial location along inlet valve bore axis 28*b*, however, each valve body first inlet passage 62 is spaced apart from the other valve body first inlet passages 62 around valve body outer periphery 50*c*. While only one valve body second inlet passage 64 is illustrated, it should be understood that a plurality of valve body second inlet passages 64 may be provided at the same axial location along inlet valve bore axis 28*b* but spaced apart from each other around valve body outer periphery 50*c*.

A valve body central passage 66 extends through valve body end wall 60 such that valve body central passage 66 connects valve body second end 50*b* with valve body bore 58 and such that valve body central passage 66 is centered about, and extends along, inlet valve bore axis 28*b*. A plurality of valve body outlet passages 68 is provided in valve body end wall 60 such that each valve body outlet passage 68 extends through valve body end wall 60 and such that each valve body outlet passage 68 connects valve body second end 50*b* with valve body bore 58. Each valve body outlet passage 68 is laterally offset from valve body central passage 66 and extends through valve body end wall 60 in a direction parallel to inlet valve bore axis 28*b*.

As shown in the figures, valve body outer periphery 50*c* may include three sections of distinct diameters. A valve body outer periphery first portion 50*d* of valve body outer periphery 50*c* begins at valve body first end 50*a* and extends to a valve body outer periphery second portion 50*e* of valve body outer periphery 50*c* such that valve body outer periphery first portion 50*d* is smaller in diameter than valve body outer periphery second portion 50*e*. As shown in the figures, valve body outer periphery first portion 50*d* may be located entirely outside of pump housing inlet passage 41 and valve body outer periphery second portion 50*e* includes valve body first inlet passage 62 and valve body second inlet passage 64 such that valve body first inlet passage 62 and valve body second inlet passage 64 are each in constant fluid communication with the portion of pump housing inlet passage 41 that is upstream of inlet valve assembly 40, i.e. valve body first inlet passage 62 and valve body second inlet passage 64 are each in constant fluid communication with the portion of pump housing inlet passage 41 that is between inlet valve assembly 40 and low-pressure fuel pump 18. A valve body outer periphery third portion 50*f* of valve body outer periphery 50*c* extends from valve body outer periphery second portion 50*e* to valve body second end 50*b* such that valve body outer periphery third portion 50*f* is larger in diameter than valve body outer periphery second portion 50*e*. Valve body outer periphery third portion 50*f* is sealingly engaged with pump housing inlet passage 41 such that fluid communication through pump housing inlet passage 41 past inlet valve assembly 40 at the interface of pump housing inlet passage 41 and valve body outer periphery third portion 50*f* is prevented and fluid communication through pump housing inlet passage 41 past inlet valve assembly 40 is only possible through valve body bore 58.

Valve spool 52 is made of a magnetic material and is centered about, and extends along, inlet valve bore axis 28*b* from a valve spool first end 52*a* to a valve spool second end 52*b*. Valve spool 52 includes a valve spool first portion 52*c* which is proximal to valve spool first end 52*a* and a valve spool second portion 52*d* which is proximal to valve spool second end 52*b*. Valve spool first portion 52*c* has a valve spool outer periphery 52*e* which is complementary with valve body bore 58 such that valve spool outer periphery 52*e* and valve body bore 58 are sized in order to substantially prevent fuel from passing between the interface of valve spool outer periphery 52*e* and valve body bore 58. As used herein, substantially preventing fuel from passing between the interface of valve spool outer periphery 52*e* and valve body bore 58 encompasses permitting small amounts of fuel passing between the interface which still allows operation of high-pressure fuel pump 20 as will readily be recognized by a practitioner of ordinary skill in the art. Valve spool second portion 52*d* includes a base portion 52*f* which extends from valve spool first portion 52*c* such that base portion 52*f* is smaller in diameter than valve spool first portion 52*c*, thereby providing an annular space radially between base portion 52*f* and valve body bore 58. Valve spool second portion 52*d* also include a tip portion 52*g* which extends from base portion 52*f* and terminates at valve spool second end 52*b*. Tip portion 52*g* is smaller in diameter than base portion 52*f*, thereby defining a valve spool shoulder 52*h* where tip portion 52*g* meets base portion 52*f*. Tip portion 52*g* is sized to be located within valve body central passage 66 of valve body 50 such that tip portion 52*g* is able to slide freely within valve body central passage 66 in the direction of inlet valve bore axis 28*b*. In use, tip portion 52*g* is used to interface with check valve 54 as will be described in greater detail later.

Valve spool first portion 52*c* is provided with a valve spool groove 70 which extends radially inward from valve spool outer periphery 52*e* such that valve spool groove 70 is annular in shape. Valve spool groove 70 is selectively aligned or not aligned with valve body first inlet passage 62 and valve body second inlet passage 64 in order to control fluid communication through pump housing inlet passage 41 as will be described in greater detail later. One or more valve spool passages 72 is provided which extend from valve spool groove 70 through valve spool first portion 52*c* toward valve spool second end 52*b*, thereby providing fluid communication between valve spool groove 70 and valve body outlet passages 68.

A valve spool end bore 74 extends into valve spool 52 from valve spool first end 52*a*. As shown, valve spool end bore 74 may include a valve spool end bore first portion 74*a* which is an internal frustoconical shape and a valve spool end bore second portion 74*b* which is cylindrical and terminates with a valve spool end bore bottom 74*c*. A valve spool connecting passage 76 provides fluid communication between valve spool groove 70 and valve spool end bore 74 such that, as shown in the figures, valve spool connecting passage 76 may be formed, by way of non-limiting example only, by a pair of perpendicular drillings.

Check valve 54 includes a check valve member 78 and a travel limiter 80. Check valve 54 is arranged at valve spool second end 52*b* such that check valve member 78 is moved between a seated position which blocks valve body outlet passages 68 (shown in FIGS. 5-7) and an open position which unblocks valve body outlet passages 68 (shown in FIG. 4) as will be described in greater detail later. Check valve member 78 includes a check valve central portion 78*a* which is a flat plate with check valve passages 78*b* extending therethrough where it is noted that only select check valve passages 78*b* have been labeled in FIG. 3 for clarity. Check valve passages 78*b* are arranged through check valve central portion 78*a* such that check valve passages 78*b* are not axially aligned with valve body outlet passages 68. A plurality of check valve legs 78*c* extend from check valve central portion 78*a* such that check valve legs 78*c* are resilient and compliant. Free ends of check valve legs 78*c* are fixed to valve body second end 50*b*, for example, by welding. Consequently, when the pressure differential between valve body bore 58 and pumping chamber 38 is sufficiently high, check valve central portion 78*a* is allowed to unseat from valve spool 52 due to elastic deformation of check valve legs 78*c*, thereby opening valve body outlet passages 68. Travel limiter 80 includes a travel limiter ring 80*a* which is axially spaced apart from valve body second end 50*b* to provide the allowable amount of displacement of check valve member 78. Travel limiter 80 also includes a plurality of travel limiter legs 80*b* which provides the axial spacing between travel limiter ring 80*a* and valve body second end 50*b*. Travel limiter legs 80*b* are integrally formed with travel limiter ring 80*a* and are fixed to valve body second end 50*b*, for example by welding.

Solenoid assembly 55 includes an inner housing 82, a pole piece 84 located within inner housing 82, a return spring 86, a spool 88, a coil 90 a flux washer 91, an overmold 92, and an outer housing 94. The various elements of solenoid assembly 55 will be described in greater detail in the paragraphs that follow.

Inner housing 82 is hollow and is stepped both internally and externally such that an inner housing first portion 82*a* is open and larger in diameter than an inner housing second portion 82*b* which is closed by an inner housing end wall 82*c*. Inner housing 82 is centered about, and extends along inlet valve bore axis 28*b*. Inner housing first portion 82*a* is received within inlet valve bore 28*a* such that inner housing first portion 82*a* is sealed to fuel pump housing 28 in order to prevent leakage of fuel from pump housing inlet passage 41 to the exterior of fuel pump housing 28. This sealing may be accomplished, by way of non-limiting example only, by one or more of interference fit between inner housing first portion 82*a* and inlet valve bore 28*a*, welding around the inner corner where inner housing first portion 82*a* meets fuel pump housing 28, and adhesives. An annular gap is provided between the inner periphery of inner housing first portion 82*a* and valve body outer periphery second portion 50*e* in order to provide fluid communication between pump housing inlet passage 41 and valve body second inlet passage 64. The inner periphery of inner housing second portion 82*b* mates with valve body outer periphery first portion 50*d* to prevent communication of fuel between the interface of the inner periphery of inner housing second portion 82*b* and valve body outer periphery first portion 50*d*.

Pole piece 84 is made of a magnetically permeable material and is received within inner housing second portion 82*b* such that pole piece 84 is centered about, and extends along, inlet valve bore axis 28*b*. A pole piece first end 84*a* is frustoconical such that the angle of pole piece first end 84*a* is complementary to the angle of valve spool end bore first portion 74*a*. In this way, pole piece first end 84*a* is received within valve spool end bore first portion 74*a*. A pole piece second end 84*b*, which is opposed to pole piece first end 84*a*, is located at the closed end of inner housing 82. A pole piece bore 84*c* extends axially through pole piece 84 from pole piece first end 84*a* to pole piece second end 84*b* such that the larger diameter portion of pole piece bore 84*c* extends into pole piece 84 from pole piece first end 84*a*, thereby defining a pole piece shoulder 84*d* which faces toward valve spool end bore bottom 74*c*. Return spring 86 is received partially with pole piece bore 84*c* such that return spring 86 abuts pole piece shoulder 84*d*. Return spring 86 is also partially received within valve spool end bore second portion 74*b* and abuts valve spool end bore bottom 74*c*. Return spring 86 is held in compression between pole piece shoulder 84*d* and valve spool end bore bottom 74*c*, and in this way, return spring 86 biases valve spool 52 away from pole piece 84.

Spool 88 is made of an electrically insulative material, for example plastic, and is centered about, and extends along, inlet valve bore axis 28*b* such that spool 88 circumferentially surrounds inner housing second portion 82*b* in a close-fitting relationship. Coil 90 is a winding of electrically conductive wire which is wound about the outer periphery of spool 88 such that coil 90 circumferentially surrounds pole piece 84. Consequently, when coil 90 is energized with an electric current, valve spool 52 is magnetically attracted to, and moved toward, pole piece 84 and when coil 90 is not energized with an electric current, valve spool 52 is moved away from pole piece 84 by return spring 86. A more detailed description of operation will be provided later.

Outer housing 94 circumferentially surrounds inner housing 82, spool 88, and coil 90 such that spool 88 and coil 90 are located radially between inner housing 82 and outer housing 94. An annular chamber 96 is formed radially between inner housing first portion 82*a* and outer housing 94 such that annular chamber 96 is located axially between the exterior of fuel pump housing 28 and a flange 94*a* of outer housing 94 which is annular in shape and which extends inward toward inner housing second portion 82*b*. Flange 94*a* provides a path for magnetic flux to pass when electric current is applied to coil 90, and as a result, a very small radial clearance is provided radially between inner housing 82 and flange 94*a*. A first sealing ring 98 is located within annular chamber 96 and is compressed axially between, and by, fuel pump housing 28 and flange 94*a*. First sealing ring 98 is made of an elastomer material, the specific composition of which is selected based on environmental factors such as temperature and liquids which may come into contact with first sealing ring 98 as would be readily recognized by a practitioner of ordinary skill in the art. First sealing ring 98 prevents liquids from the outside environment from migrating to inner housing 82 where the liquids could otherwise collect and be difficult to dry out which could cause degradation to inner housing 82, particularly in the small radial gap between inner housing 82 and flange 94*a* of outer housing 94 where crevasse corrosion erosion can occur if liquid is allowed to accumulate. It is important to note that first sealing ring 98 plays no role in sealing fuel within high-pressure fuel pump 20, i.e. first sealing ring 98 is not exposed to fuel within high-pressure fuel pump 20, and is provided to prevent intrusion of liquids that are present in the environment outside of high-pressure fuel pump 20. In addition to the main purpose of preventing intrusion of liquids that are present in the environment outside of high-pressure fuel pump 20, first sealing ring 98 may also provide suppression of vibrations and audible noise created from operation of high-pressure fuel pump 20 during operation that could otherwise be transmitted to the environment.

Flux washer 91 is located within outer housing 94 such that the outer periphery of flux washer 91 engages the inner periphery of outer housing 94 and such that spool 88 and coil 90 are located axially between flange 94*a* and flux washer 91. Flux washer 91 provides a path for magnetic flux to pass when electric current is applied to coil 90, and as a result, a very small radial clearance is provided radially between inner housing 82 and flux washer 91.

Overmold 92 is an electrically insulative material, for example plastic, which fills the void between spool 88/coil 90 and outer housing 94 such that overmold 92 extends axially from outer housing 94 to define an electrical connector 100 which includes terminals (not shown) that are connected to opposite ends of coil 90. Electrical connector 100 is configured to mate with a complementary electrical connector (not show) for supplying electric current to coil 90 in use. Overmold 92 includes a central aperture 92*a* which extends to flux washer 91 along inlet valve bore axis 28*b*. Inner housing 82 extends into central aperture 92*a* such that an annular gap 102 is formed radially between overmold 92 and inner housing 82. A second sealing ring 104 is located within annular gap 102 and is compressed radially between, and by, overmold 92 and inner housing 82. Second sealing ring 104 is made of an elastomer material, the specific composition of which is selected based on environmental factors such as temperature and liquids which may come into contact with second sealing ring 104 as would be readily recognized by a practitioner of ordinary skill in the art. Unlike first sealing ring 98 which is circular in cross-sectional shape prior to installation, second sealing ring 104 may be elongated in a direction parallel to inlet valve bore axis 28*b* prior to installation in order to provide structural integrity to second sealing ring 104 since second sealing ring 104 is not captured in a direction parallel to inlet valve bore axis 28*b*. This cross-sectional shape also prevents rolling of second sealing ring 104 during installation into annular gap 102. Second sealing ring 104 prevents liquids from the outside environment from migrating to the small radial clearance between inner housing 82 and flux washer 91 where the liquids could otherwise collect and be difficult to dry out and crevasse corrosion erosion can occur if liquid is allowed to accumulate. It is important to note that second sealing ring 104 plays no role in sealing fuel within high-pressure fuel pump 20, i.e. second sealing ring 104 is not exposed to fuel within high-pressure fuel pump 20, and is provided to prevent intrusion of liquids that are present in the environment outside of high-pressure fuel pump 20. In addition to the main purpose of preventing intrusion of liquids that are present in the environment outside of high-pressure fuel pump 20, second sealing ring 104 may also provide suppression of vibrations and audible noise created from operation of high-pressure fuel pump 20 during operation that could otherwise be transmitted to the environment.

Figure 4:
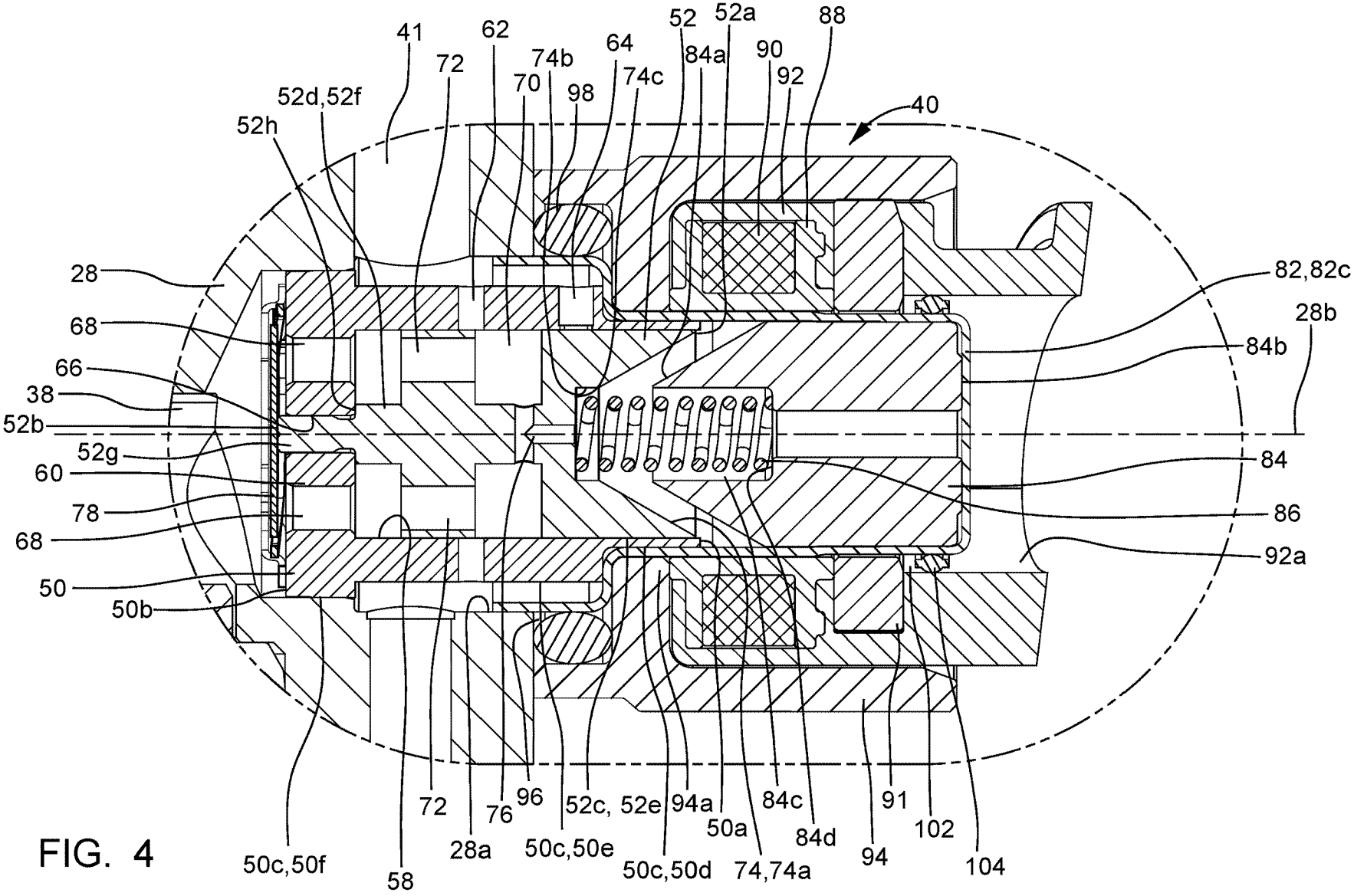
FIG. 4 is an enlargement of a portion of FIG. 2 showing the inlet valve assembly of the fuel pump in a first position.

Operation of high-pressure fuel pump 20, and in particular, inlet valve assembly 40, will now be described with particular reference to FIG. 4 which shows valve spool 52 in a first position which results from no electric current being supplied to coil 90 of solenoid assembly 55. When no electric current is supplied to coil 90, return spring 86 urges valve spool 52 away from pole piece 84 until valve spool shoulder 52*h* abuts valve body end wall 60 which allows tip portion 52*g* of valve spool 52 to protrude beyond valve body second end 50*b* such that tip portion 52*g* holds check valve member 78 in an unseated position which permits flow through valve body outlet passages 68 and such that valve body outlet passages 68 are in fluid communication with pumping chamber 38. Also in the first position, valve spool groove 70 is aligned with valve body first inlet passage 62, however, it is noted that valve spool groove 70 is not aligned with valve body second inlet passage 64. In this way, valve spool 52 maintains check valve member 78 in the unseated position and valve body first inlet passage 62 is in fluid communication with valve body outlet passages 68. It should be noted that in the first position, alignment between valve spool groove 70 and valve body first inlet passage 62 provides a path to pump housing inlet passage 41. In this way, the first position is a default position that provides limp-home operation of high-pressure fuel pump 20, that is, if electrical power to solenoid assembly 55 is unintentionally interrupted, fuel in sufficient quantity and pressure is supplied to fuel injectors 16 by low-pressure fuel pump 18 for continued operation of internal combustion engine 12, although without the fuel being pressurized by high-pressure fuel pump 20 since check valve member 78 being held in the unseated position by valve spool 52 prevents pressurization of fuel by pumping plunger 34. It should be noted that the path to pump housing inlet passage 41 which enables the limp-home operation of high-pressure fuel pump 20 also enables the use of only one pressure-relief valve, i.e. pressure relief valve assembly 48.

Figure 5:
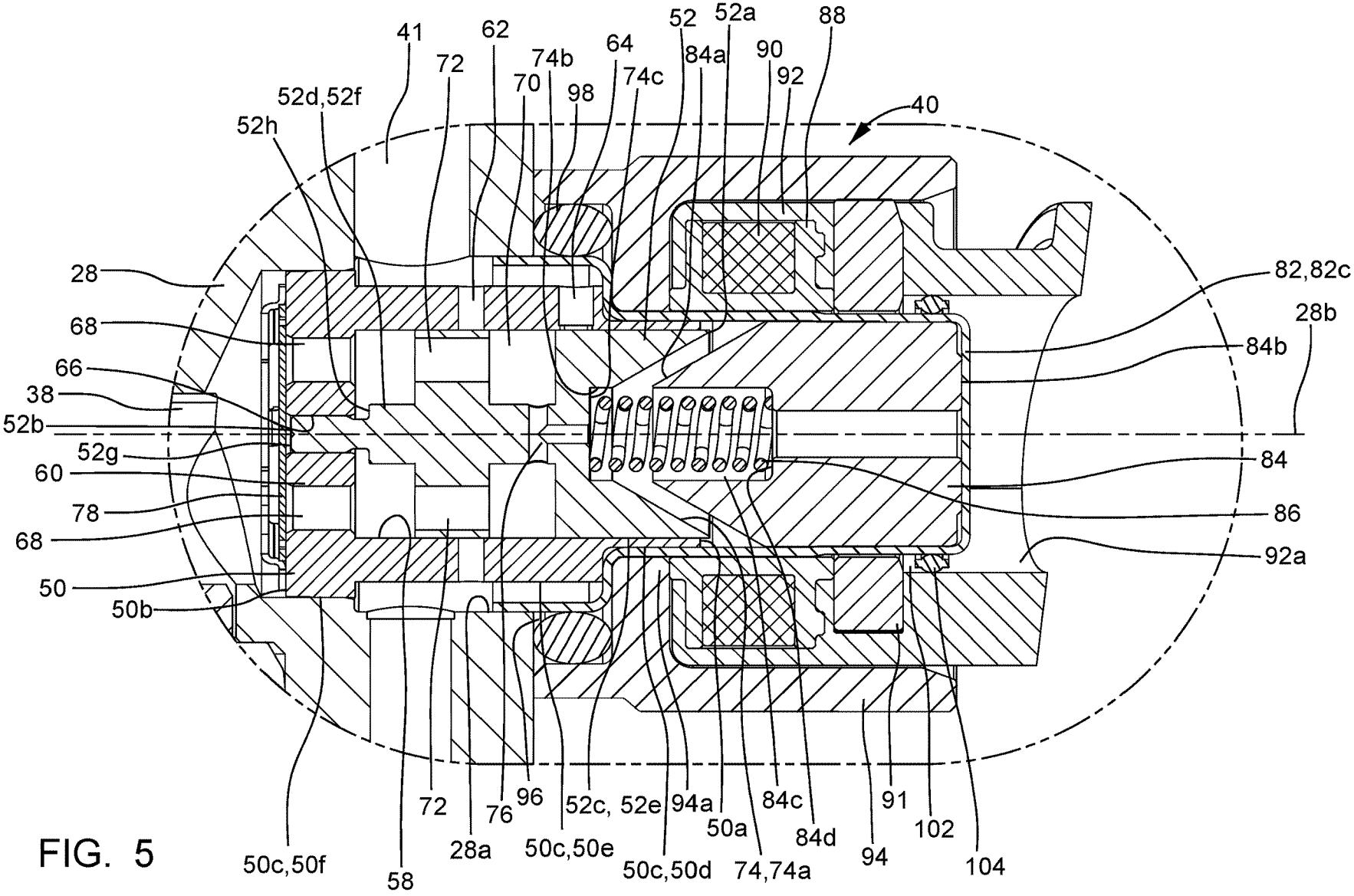
FIG. 5 is the view of FIG. 4, now showing the inlet valve assembly in a second position.

Now with particular reference to FIG. 5, valve spool 52 is shown in a second position which results from electric current being supplied to coil 90 of solenoid assembly 55 at a first duty cycle. When electric current is supplied to coil 90 at the first duty cycle, valve spool 52 is attracted to pole piece 84, thereby moving valve spool 52 toward pole piece 84 and compressing return spring 86 to a greater extent than in the first position. Valve spool connecting passage 76 allows fuel located between valve spool 52 and pole piece 84 to be displaced toward valve body outlet passages 68 during movement of valve spool 52 toward pole piece 84 and also allows pressure to equalize on each axial end of valve spool 52. In the second position, tip portion 52*g* is positioned to no longer protrude beyond valve body second end 50*b*, and consequently, check valve member 78 is moved to a seated position which prevents flow into valve body bore 58 through valve body outlet passages 68. Also in the second position, valve spool groove 70 is not aligned with valve body first inlet passage 62 and is also not aligned with valve body second inlet passage 64, and in this way, fuel is prevented from entering or exiting valve body bore 58 through valve body first inlet passage 62 and valve body second inlet passage 64. Consequently, valve body first inlet passage 62 and valve body second inlet passage 64 is not in fluid communication with valve body outlet passages 68. The second position of valve spool 52 is used when internal combustion engine 12 is in operation but is not requesting fuel to be supplied from fuel injectors 16 as may occur during a fuel deceleration cutoff event when an automobile is coasting and no fuel is being commanded. In this way, the second position prevents fuel from being supplied to fuel injectors 16.

Figure 6:
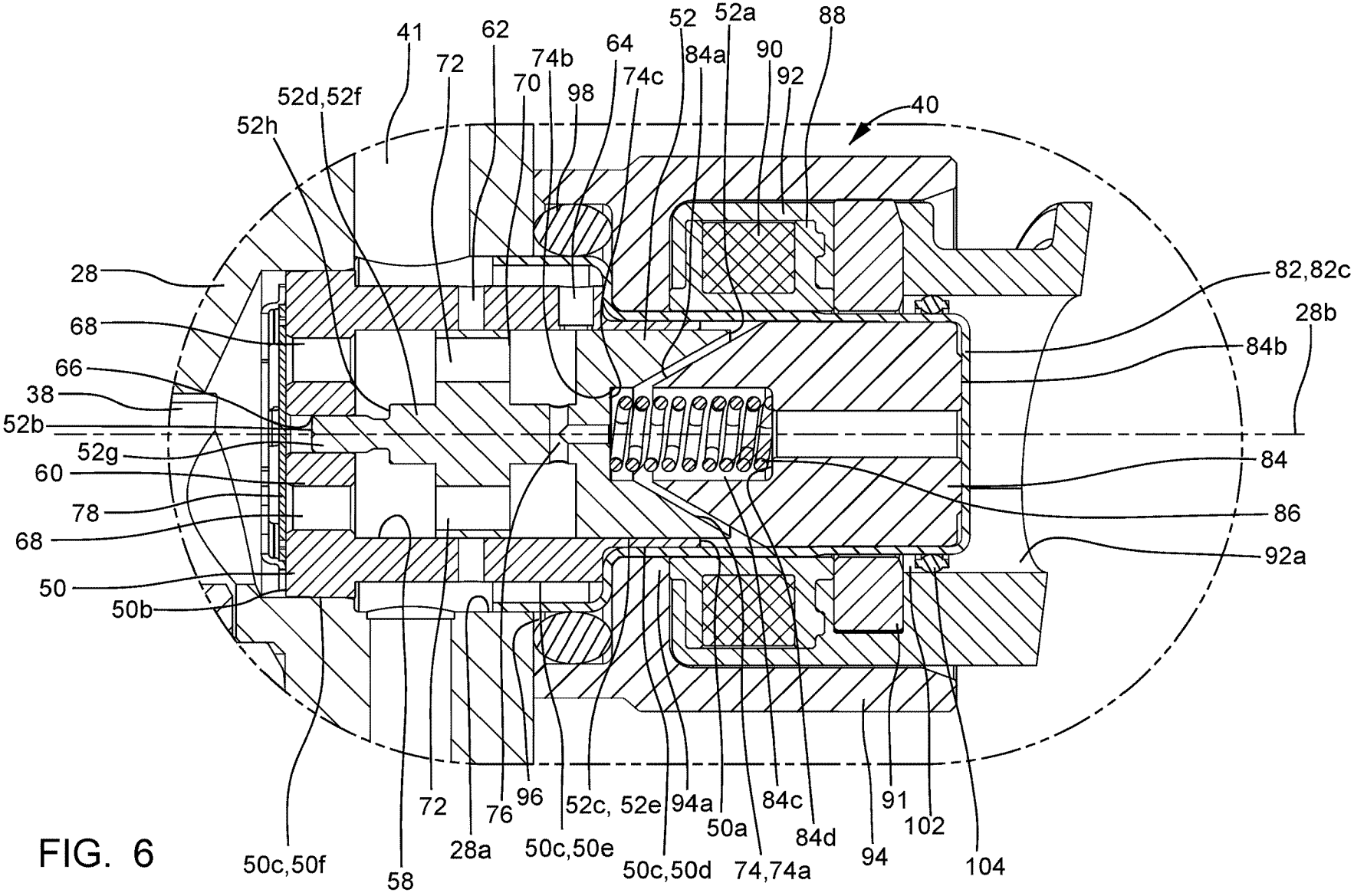
FIG. 6 is the view of FIGS. 4 and 5, now showing the inlet valve assembly in a third position.

Now with particular reference to FIG. 6, valve spool 52 is shown in a third position which results from electric current being supplied to coil 90 of solenoid assembly 55 at a second duty cycle which is greater than the first duty cycle used to achieve the second position of valve spool 52. When electric current is supplied to coil 90 at the second duty cycle, valve spool 52 is attracted to pole piece 84, thereby moving valve spool 52 toward pole piece 84 and compressing return spring 86 to a greater extent than in the second position. Just as in the second position, the third position results in tip portion 52*g* being positioned to no longer protrude beyond valve body second end 50*b*, and consequently, check valve member 78 is moved to a seated position which prevents flow into valve body bore 58 through valve body outlet passages 68. However, it should be noted that check valve member 78 is able to move to the unseated position when the pressure differential between valve body bore 58 and pumping chamber 38 is sufficiently high, i.e. during the intake stroke. Also in the third position, valve spool groove 70 is not aligned with valve body first inlet passage 62, however, valve spool groove 70 is now aligned with valve body second inlet passage 64, and in this way, fuel is allowed to valve body bore 58 through valve body second inlet passage 64. Consequently, during the intake stroke of pumping plunger 34, a pressure differential is created which allows fuel to flow through inlet valve assembly 40 through valve body second inlet passage 64, thereby moving check valve member 78 to the unseated position which allows fuel to flow into pumping chamber 38. During the compression stroke of pumping plunger 34, pressure increases within pumping chamber 38, thereby causing check valve member 78 to move to the seated position which prevents fuel from flowing from pumping chamber 38 into valve body bore 58 and which allows the pressurized fuel within pumping chamber 38 to be discharged through outlet valve assembly 42. The third position of valve spool 52 is used when internal combustion engine 12 is required to produce a light output torque since it is noted that alignment of valve spool groove 70 with valve body second inlet passage 64 provides a restricted passage which thereby meters a small amount of fuel to pumping chamber 38 during the intake stroke of pumping plunger 34 to support fueling of internal combustion engine 12 at light loads.

Figure 7:
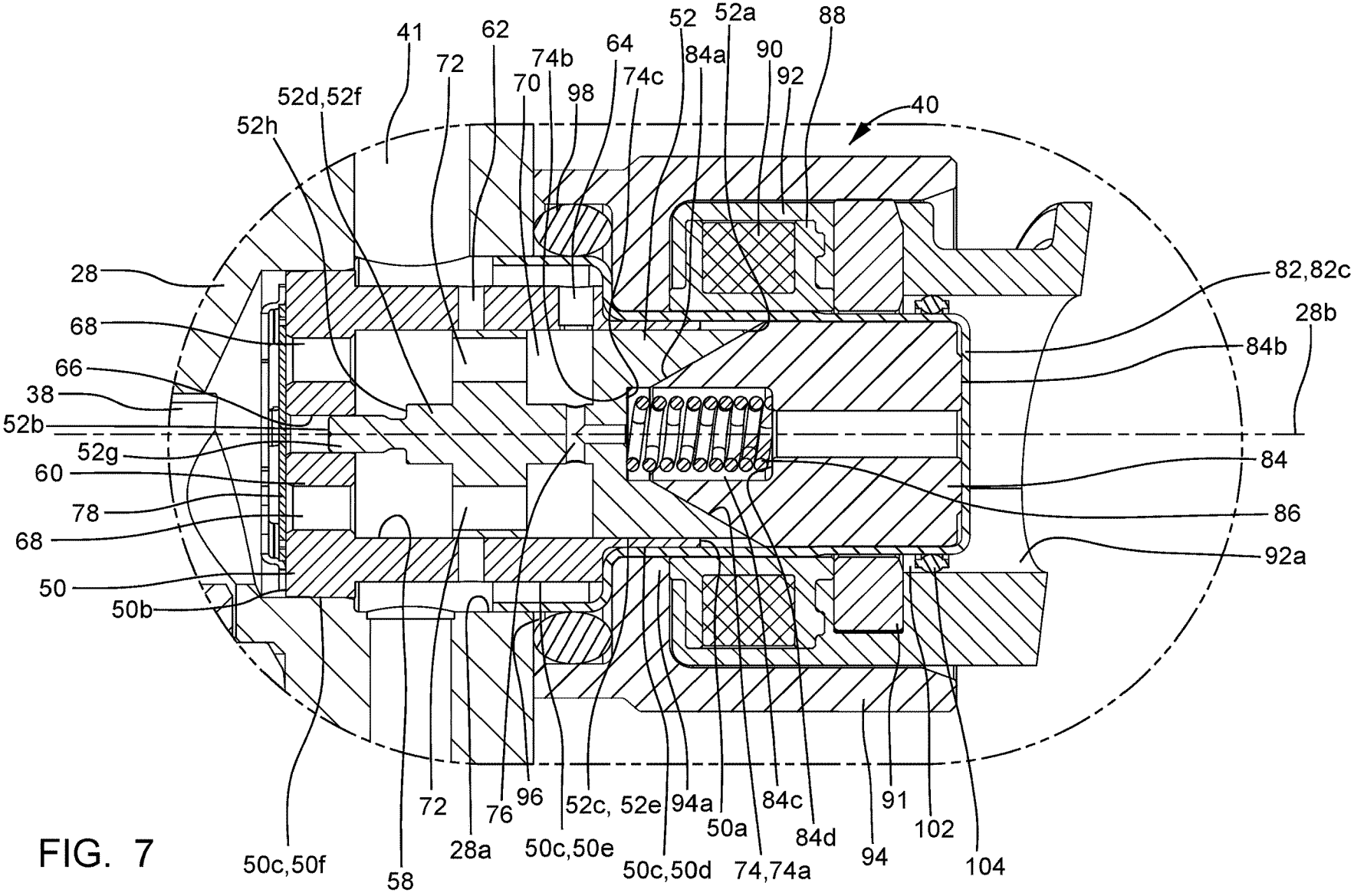
FIG. 7 is the view of FIGS. 4-6, now showing the inlet valve assembly in a fourth position.

Now with particular reference to FIG. 7, valve spool 52 is shown in a fourth position which results from electric current being supplied to coil 90 of solenoid assembly 55 at a third duty cycle which is greater than the second duty cycle used to achieve the third position of valve spool 52. When electric current is supplied to coil 90 at the third duty cycle, valve spool 52 is attracted to pole piece 84, thereby moving valve spool 52 toward pole piece 84 and compressing return spring 86 to a greater extent than in the third position. Just as in the second and third positions, the fourth position results in tip portion 52*g* being positioned to no longer protrude beyond valve body second end 50*b*, and consequently, check valve member 78 is moved to a seated position which prevents flow into valve body bore 58 through valve body outlet passages 68. However, it should be noted that check valve member 78 is able to move to the unseated position when the pressure differential between valve body bore 58 and pumping chamber 38 is sufficiently high, i.e. during the intake stroke. Also in the fourth position, just as in the third position, valve spool groove 70 is not aligned with valve body first inlet passage 62, however, valve spool groove 70 is now aligned with valve body second inlet passage 64, and in this way, fuel is allowed to valve body bore 58 through valve body second inlet passage 64. Consequently, during the intake stroke of pumping plunger 34, a pressure differential is created which allows fuel to flow through inlet valve assembly 40 through valve body second inlet passage 64, thereby moving check valve member 78 to the unseated position which allows fuel to flow into pumping chamber 38. During the compression stroke of pumping plunger 34, pressure increases within pumping chamber 38, thereby causing check valve member 78 to move to the seated position which prevents fuel from flowing from pumping chamber 38 into valve body bore 58 and which allows the pressurized fuel within pumping chamber 38 to be discharged through outlet valve assembly 42. As should now be apparent, the third and fourth positions of valve spool 52 are nearly identical, however, the fourth position differs from the third position in that the alignment of valve spool groove 70 with valve body second inlet passage 64 is less restrictive than in the third position. Consequently, the fourth position of valve spool 52 is used when internal combustion engine 12 is required to produce a higher output torque since the alignment of valve spool groove 70 with valve body second inlet passage 64 provides a less restrictive passage which thereby meters a larger amount of fuel, compared to the third position, to pumping chamber 38 during the intake stroke of pumping plunger 34 to support fueling of internal combustion engine 12 at high loads.

As should now be clear, different duty cycles can be provided to vary the amount of fuel metered to pumping chamber 38 where the different duty cycles result in varying magnitudes of alignment of valve spool groove 70 with valve body second inlet passage 64, thereby varying the magnitude of restriction. In other words, the third and fourth positions as described above are only examples of positions of valve spool 52, and other duty cycles can be provided in order to provide different metered amounts of fuel to pumping chamber 38 in order to achieve different output torques of internal combustion engine 12. An electronic control unit 106 may be used to supply electric current to coil 90 at the various duty cycles described herein. Electronic control unit 106 may receive input from a pressure sensor 108 which senses the pressure within fuel rail 44 in order to provide a proper duty cycle to coil 90 in order to maintain a desired pressure in fuel rail 44 which may vary based on the commanded torque desired to be produced by internal combustion engine 12.

While inner housing 82 has been illustrated and described herein as directly engaging and being welded directly to fuel pump housing 28, it should be understood that an intermediate element, such as a sleeve (not shown), may be provided radially between inner housing 82 and fuel pump housing 28 and this intermediate element will be considered within the scope of this disclosure to be fuel pump housing 28.

Figure 8:
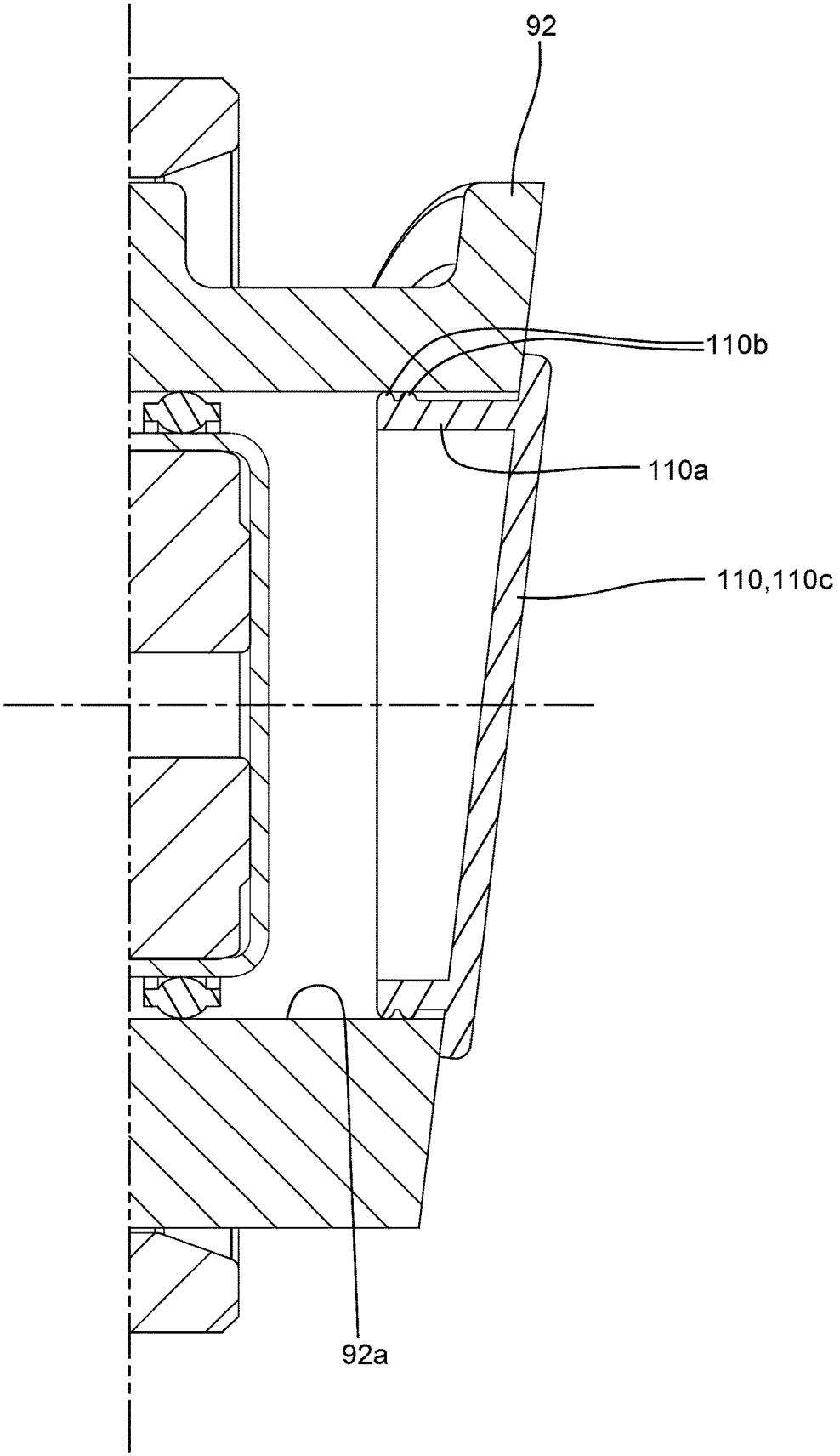
FIG. 8 shows a sealing cap in accordance with the present disclosure.

In addition to or in the alternative to second sealing ring 104, a sealing cap 110 may be provided as shown in FIG. 8 which closes off the open end of central aperture 92*a* which is opposite from flux washer 91. Sealing cap 110 may include a sidewall 110*a* which is annular in shape and which fits within central aperture 92*a* in an interference fit, for example by way of one or more annular ribs 100*b* of sidewall 110*a* which circumferentially surround sidewall 110*a*, in order to retain sealing cap 110 to overmold 92 and to prevent intrusion of liquids. Sealing cap 110 may also include an end wall 110*c* which closes off one open end of sidewall 110*a* such that end wall 110*c* extends radially outward from sidewall 110*a*, thereby forming a stop which limits the extent to which sealing cap 110 is inserted into central aperture 92*a*. Sealing cap 110 is made of an elastomer material, the specific composition of which is selected based on environmental factors such as temperature and liquids which may come into contact with first sealing ring 98 as would be readily recognized by a practitioner of ordinary skill in the art. Sealing cap 110 prevents liquid from entering central aperture 92*a*, thereby preventing liquid from migrating to areas which can cause degradation as described previously with respect to second sealing ring 104. It is important to note that sealing cap 110 plays no role in sealing fuel within high-pressure fuel pump 20, i.e. sealing cap 110 is not exposed to fuel within high-pressure fuel pump 20, and is provided to prevent intrusion of liquids that are present in the environment outside of high-pressure fuel pump 20. In addition to the main purpose of preventing intrusion of liquids that are present in the environment outside of high-pressure fuel pump 20, sealing cap 110 may also provide suppression of vibrations and audible noise created from operation of high-pressure fuel pump 20 during operation that could otherwise be transmitted to the environment.

High-pressure fuel pump 20 as described herein with one or more of first sealing ring 98, second sealing ring 104, and sealing cap 110 minimizes the likelihood of liquids from the exterior environment from reaching elements of inlet valve assembly 40 and solenoid assembly 55 which could otherwise lead to undesired operation of inlet valve assembly 40 or solenoid assembly 55. Furthermore, vibrations and audible noise created from operation of high-pressure fuel pump 20 may be suppressed.

While this invention has been described in terms of preferred embodiments thereof, it is not intended to be so limited, but rather only to the extent set forth in the claims that follow.

We claim:

1. A fuel pump comprising:

a fuel pump housing with a pumping chamber defined therein and an inlet valve bore extending along an inlet valve bore axis to an exterior of said fuel pump housing;

a pumping plunger which reciprocates within a plunger bore such that an intake stroke of said pumping plunger increases a volume of said pumping chamber and a compression stroke of said pumping plunger decreases the volume of said pumping chamber; and an inlet valve assembly which 1) selectively provides fluid communication between an inlet of said fuel pump and said pumping chamber and 2) selectively prevents fluid communication between said inlet of said fuel pump and said pumping chamber, said inlet valve assembly comprising:

an inner housing which is received within said inlet valve bore such that said inner housing extends to the exterior of said fuel pump housing and such that an outer periphery of said inner housing is sealed to an inner periphery of said inlet valve bore such that fuel is prevented from passing radially between said inner housing and said inlet valve bore to the exterior of said fuel pump housing;

an outer housing which is located outside of said fuel pump housing and circumferentially surrounds said inner housing, wherein an annular chamber is defined radially between said inner housing and said outer housing and axially between said outer housing and said fuel pump housing; and a sealing ring which is made of an elastomer material and which is annular in shape and located within said annular chamber such that said sealing ring is compressed axially against said fuel pump housing and said outer housing;

wherein said sealing ring is not exposed to fuel from within said fuel pump.

2. A fuel pump as in claim 1, wherein said inlet valve assembly includes a solenoid assembly, said solenoid assembly comprising:

said inner housing;

said outer housing;

a pole piece made of a magnetically permeable material located within said inner housing;

a coil of electrically conductive wire which circumferentially surrounds said pole piece and such that said coil is located radially between said inner housing and said outer housing, wherein electricity is applied to coil causes a magnetic attraction between said pole piece and a valve element of said inlet valve assembly such that said valve element moves toward said pole piece.

3. A fuel pump as in claim 2, wherein:

said outer housing includes a flange which is annular in shape and which extends inward toward said inner housing such that said flange provides a path for magnetic flux to pass when electricity is applied to said coil; and said sealing ring is compressed axially against said flange.

4. A fuel pump as in claim 2, wherein:

said solenoid assembly further comprises an overmold which is made of an electrically insulative material and which fills between said coil and said outer housing, said overmold including a central aperture;

said inner housing extends into said central aperture such that an annular gap is located radially between said inner housing and said central aperture;

said sealing ring is a first sealing ring; and said solenoid assembly further comprises a second sealing ring which is made of an elastomer material and which is annular in shape and located within said annular gap such that said second sealing ring is radially compressed against said inner housing and said overmold.

5. A fuel pump as in claim 2, wherein said solenoid assembly further comprises an overmold which is made of an electrically insulative material and which fills between said coil and said outer housing, said overmold including a central aperture;

said inner housing extends into said central aperture such that an annular gap is located radially between said inner housing and said central aperture;

said solenoid assembly further comprises sealing cap which closes off said central aperture.

6. A fuel pump as in claim 5, wherein said sealing cap is not exposed to fuel from within said fuel pump.

7. A fuel pump as in claim 4, wherein said second sealing ring is not exposed to fuel from within said fuel pump.

8. A fuel pump comprising:

a fuel pump housing with a pumping chamber defined therein and an inlet valve bore extending along an inlet valve bore axis to an exterior of said fuel pump housing;

a pumping plunger which reciprocates within a plunger bore such that an intake stroke of said pumping plunger increases a volume of said pumping chamber and a compression stroke of said pumping plunger decreases the volume of said pumping chamber; and an inlet valve assembly which 1) selectively provides fluid communication between an inlet of said fuel pump and said pumping chamber and 2) selectively prevents fluid communication between said inlet of said fuel pump and said pumping chamber, said inlet valve assembly comprising:

an inner housing which is received within said inlet valve bore such that said inner housing extends to the exterior of said fuel pump housing and such that an outer periphery of said inner housing is sealed to an inner periphery of said inlet valve bore such that fuel is prevented from passing radially between said inner housing and said inlet valve bore to the exterior of said fuel pump housing;

an outer housing which is located outside of said fuel pump housing and circumferentially surrounds said inner housing, wherein an annular chamber is defined radially between said inner housing and said outer housing and axially between said outer housing and said fuel pump housing; and a first sealing ring which is made of an elastomer material and which is annular in shape and located within said annular chamber such that said first sealing ring is compressed axially against said fuel pump housing and said outer housing;

wherein said inlet valve assembly includes a solenoid assembly, said solenoid assembly comprising:

said inner housing;

said outer housing;

a pole piece made of a magnetically permeable material located within said inner housing; and a coil of electrically conductive wire which circumferentially surrounds said pole piece and such that said coil is located radially between said inner housing and said outer housing, wherein electricity is applied to coil causes a magnetic attraction between said pole piece and a valve element of said inlet valve assembly such that said valve element moves toward said pole piece;

wherein said solenoid assembly further comprises an overmold which is made of an electrically insulative material and which fills between said coil and said outer housing, said overmold including a central aperture;

wherein said inner housing extends into said central aperture such that an annular gap is located radially between said inner housing and said central aperture;

wherein said solenoid assembly further comprises a second sealing ring which is made of an elastomer material and which is annular in shape and located within said annular gap such that said second sealing ring is radially compressed against said inner housing and said overmold; and wherein said second sealing ring is not exposed to fuel from within said fuel pump.

9. A fuel pump as in claim 8, wherein said first sealing ring is not exposed to fuel from within said fuel pump.

10. A fuel pump comprising:

a fuel pump housing with a pumping chamber defined therein and an inlet valve bore extending along an inlet valve bore axis to an exterior of said fuel pump housing;

a pumping plunger which reciprocates within a plunger bore such that an intake stroke of said pumping plunger increases a volume of said pumping chamber and a compression stroke of said pumping plunger decreases the volume of said pumping chamber; and an inlet valve assembly which 1) selectively provides fluid communication between an inlet of said fuel pump and said pumping chamber and 2) selectively prevents fluid communication between said inlet of said fuel pump and said pumping chamber, said inlet valve assembly comprising:

an inner housing which is received within said inlet valve bore such that said inner housing extends to the exterior of said fuel pump housing and such that an outer periphery of said inner housing is sealed to an inner periphery of said inlet valve bore such that fuel is prevented from passing radially between said inner housing and said inlet valve bore to the exterior of said fuel pump housing;

an outer housing which is located outside of said fuel pump housing and circumferentially surrounds said inner housing, wherein an annular chamber is defined radially between said inner housing and said outer housing and axially between said outer housing and said fuel pump housing; and a sealing ring which is made of an elastomer material and which is annular in shape and located within said annular chamber such that said sealing ring is compressed axially against said fuel pump housing and said outer housing;

wherein said inlet valve assembly includes a solenoid assembly, said solenoid assembly comprising:

said inner housing;

said outer housing;

a pole piece made of a magnetically permeable material located within said inner housing; and a coil of electrically conductive wire which circumferentially surrounds said pole piece and such that said coil is located radially between said inner housing and said outer housing, wherein electricity is applied to coil causes a magnetic attraction between said pole piece and a valve element of said inlet valve assembly such that said valve element moves toward said pole piece;

wherein said solenoid assembly further comprises an overmold which is made of an electrically insulative material and which fills between said coil and said outer housing, said overmold including a central aperture;

wherein said inner housing extends into said central aperture such that an annular gap is located radially between said inner housing and said central aperture;

wherein said solenoid assembly further comprises sealing cap which closes off said central aperture; and wherein said sealing cap comprises:

a sidewall which is located within said central aperture in an interference fit; and an end wall which extends radially outward from said sidewall which abuts said overmold and limits how far said sealing cap is inserted into said central aperture.

* * * * *